US011839286B2

(12) United States Patent
Choi

(10) Patent No.: US 11,839,286 B2
(45) Date of Patent: Dec. 12, 2023

(54) COSMETIC CONTAINER CAP WITH DUO-MIX FUNCTION

(71) Applicant: Kugil Co., LTD., Pyeongtaek-si (KR)

(72) Inventor: Jong-Sou Choi, Hwaseong-si (KR)

(73) Assignee: Kugil Co., LTD., Pyeongtaek-si (KR)

( * ) Notice: Subject to any disclaimer, the term of this patent is extended or adjusted under 35 U.S.C. 154(b) by 0 days.

(21) Appl. No.: 17/850,651

(22) Filed: Jun. 27, 2022

(65) Prior Publication Data

US 2023/0056458 A1 Feb. 23, 2023

(30) Foreign Application Priority Data

Aug. 20, 2021 (KR) ..... 10-2021-0109820

(51) Int. Cl.
*A45D 34/04* (2006.01)
*B05B 11/10* (2023.01)

(52) U.S. Cl.
CPC ..... *A45D 34/04* (2013.01); *B05B 11/1081* (2023.01); *A45D 2200/056* (2013.01)

(58) Field of Classification Search
CPC ..... A45D 34/04; A45D 2200/056; B05B 11/1081; B01L 3/0282; B65D 47/18; B65D 81/3222; B65D 81/3216; B65D 81/3255
See application file for complete search history.

(56) References Cited

U.S. PATENT DOCUMENTS 4,579,153 A * 4/1986 Goncalves ..... B01L 3/0282 422/934
2013/0074983 A1* 3/2013 Choi ..... B05B 11/1047 141/23
2014/0020789 A1* 1/2014 Duquet ..... B01L 3/0272 141/24
2015/0232240 A1* 8/2015 Lee ..... B65D 53/00 220/288
2015/0257510 A1* 9/2015 Kim ..... A45D 34/045 401/126
2015/0320175 A1* 11/2015 Lee ..... B65D 51/32 222/372
2017/0006999 A1* 1/2017 Moon ..... A45D 34/04
2017/0082475 A1* 3/2017 Ham ..... B65D 47/00
2017/0181525 A1* 6/2017 Hwang ..... B01F 35/7131
2017/0231365 A1* 8/2017 Choi ..... A45D 34/04 222/383.1
2019/0053600 A1* 2/2019 Kim ..... A45D 34/045
2020/0154851 A1* 5/2020 Jacob ..... B05B 11/1047
(Continued)

*Primary Examiner* — Patrick M. Buechner
(74) *Attorney, Agent, or Firm* — NKL Law; Jae Youn Kim

(57) ABSTRACT

Proposed is a cosmetic container cap with a duo-mix function. In its body, a female fastening portion is formed below an upper open-type chamber where an accommodation space is formed to accommodate a first cosmetic content of liquid or powder to be fastened to a male fastening portion formed to be exposed in a container. A hollow dip tube is formed to extend a predetermined length downward from the chamber. A pumping member coupled to the chamber of the body part is configured to press down the first cosmetic content toward the container for mixing it with a second cosmetic content inside the container, and to pump a mixture of the first and second cosmetic contents into the dip tube and the chamber for discharging outside. A dip tube sealing cap closes and opens the dip tube, which enables mixing the first and second cosmetic contents.

4 Claims, 15 Drawing Sheets

(56) References Cited

U.S. PATENT DOCUMENTS

| | | | | |
|---|---|---|---|---|
| 2021/0206542 | A1* | 7/2021 | Kim | B65D 47/18 |
| 2023/0109263 | A1* | 4/2023 | Choi | A45D 34/04 206/581 |

* cited by examiner

COSMETIC CONTAINER CAP WITH DUO-MIX FUNCTION

CROSS REFERENCE TO RELATED APPLICATION

The present application claims priority to Korean Patent Application No. 10-2021-0109820, filed Aug. 20, 2021, the entire contents of which is incorporated herein for all purposes by this reference.

BACKGROUND OF THE INVENTION

Field of the Invention

The present disclosure relates to a cosmetic container cap with a duo-mix function and, more particularly, to a cosmetic container cap with a duo-mix function, which enables to separately accommodate powder or liquid first and second cosmetic contents in a cap and container, respectively, and allows the first and second cosmetic contents to mix at the time desired by a consumer or user (before using the cosmetics) to use.

Description of the Related Art

In general, there are cosmetics that are manufactured and used as single-content products, and cosmetics that are manufactured as multi-content products containing two different contents and supplied to consumers in a state of being stored separately from each other, and then mixed and used at a time desired by the consumer.

In other words, if different types of cosmetic contents are mixed in advance and distributed, ingredients of the mixed cosmetic contents may be degraded in the distribution process due to internal chemical reactions, or the efficacy may be significantly reduced.

There are cases where, after storing two different types of cosmetic contents separately in two respective containers, a user transfers the content stored in one container to another container and mixes the two contents together, but this has a problem in that it is inconvenient.

Accordingly, a cosmetic mixing container having a structure in which two types of cosmetic contents may be mixed with the help of a user's hand after being stored together in a separated state in one container has been devised and used in the related art to solve the above-mentioned problem of inconvenience.

However, as described above, even in the method where different types of cosmetic contents are stored separately in the distribution process and mixed just before use, the user has to take an additional action to mix the different types of cosmetic contents so that the contents are mixed together, which is troublesome.

That is, as shown in FIG. 1, the first cosmetic content is stored in a dropper 10. More specifically, the first cosmetic content is stored in a pumping part 4 made of an elastic material such as silicone rubber or elastomer and in a dip tube 6 coupled to the pumping part 4, and the second cosmetic content is stored in a container 12.

At the lower discharge port of the dip tube 6, a sealing cap 8 is coupled as shown in FIG. 1A in a pressed fit manner, so that a cosmetic product is stored or distributed in a state in which the mixing of the first cosmetic content and the second cosmetic content is prevented.

When the consumer wants to use the product, the dropper 10 may be separated from the cosmetic container and lifted as shown in FIG. 1B, and as the sealing cap 8 coupled to the discharge port of the dip tube 6 comes into contact with a brush 2, the sealing cap 8 is separated from the dip tube 6, and the first cosmetic content stored in the pumping part 4 and the dip tube 6 flows into the container 12 so that the first cosmetic content and the second cosmetic content are mixed.

However, in the above-described cosmetic container with a different content mixing function, depending on the coupling strength with which the sealing cap 8 is press-fitted to the discharge port, the sealing cap 8 may not be separated even when in contact with the brush 2, which causes a problem and inconvenience in that the brush 2 needs to be lifted from the container to be separated.

Moreover, since the connection structure of the dip tube 6 and the pumping part 4 is a concave-convex coupling, when the pumping part 4 is pressurized while the sealing cap 8 is not separated, the first cosmetic content flows out to the concave-convex coupling portion, making the container 12 dirty, and there are other problems such as causing inconvenience to the user.

SUMMARY OF THE INVENTION

Accordingly, the present disclosure has been made keeping in mind the above problems occurring in the related art, and the present disclosure is intended to provide a cosmetic container cap with a duo-mix function, which prevents unintentional mixing of different cosmetic contents, allows mixing of different cosmetic contents with a simple action without removing the cap of the cosmetic container from the container when mixing different cosmetic contents, and enables easy pumping of the cosmetic mixture.

In order to achieve the above objective, according to an embodiment of the present disclosure, there is provided a cosmetic container cap with a duo-mix function, the cosmetic container cap including: a body part 102 in which a female fastening portion 102*b* is formed below an upper open-type chamber 102*a* where an accommodation space is formed to accommodate a first cosmetic content A of liquid or powder so as to be fastened to a male fastening portion 204 formed to be exposed in a container 202, and having a hollow dip tube 102*c* formed to extend a predetermined length downward from the chamber 102*a*; a pumping member 110 coupled to the chamber 102*a* of the body part 102 to press down the first cosmetic content A toward the container 202 to be mixed with a second cosmetic content B inside the container 202, and configured to pump a cosmetic mixture C in which the first cosmetic content A and the second cosmetic content B are mixed into the dip tube 102*c* and the chamber 102*a* to be discharged outside; and a dip tube sealing means for closing and opening the dip tube 102*c* so that the first cosmetic content A and the second cosmetic content B are mixed.

The pumping member 110 may include: a pumping material 112 including a close-contact portion 112*a* that is in close contact with an upper periphery of an inner diameter surface of the chamber 102*a* and descends by a downward pressing force applied from the outside, and an elastic portion 112*b* that is formed upwardly convex in the close-contact portion 112*a* and is elastically restored upward when pressed downward; at least one first hook 114 formed on an outer diameter of the chamber 102*a*; a button part 116 inserted downward into an outer diameter of the chamber 102*a*, having a second hook 116*a* formed on an inner diameter of a lower end thereof so that the button part 116 is interfered upward after being forced through the first hook 114 when inserted downward, and having a pressing portion 116*b*, which is in close contact with an upper portion of an elastic portion 112*b* when the button part 116 is inserted downward into the outer diameter of the chamber 102*a*, formed to extend downward from a bottom thereof; and a third hook 118 formed at a predetermined height of the outer diameter of the chamber 102*a* so that the first hook 114 of the button part 116 is interfered upward after being forced through when the button part 116 is lowered.

In addition, in the dip tube sealing means, a first inner diameter 102*c*-1 of a predetermined length formed on the upper portion of the dip tube 102*c* may be formed narrower than a second inner diameter 102*c*-2 of a predetermined length formed on the lower portion of the dip tube 102*c*, and the dip tube sealing means may include a sealing part 120 loosely inserted upward from the lower end of the dip tube 102*c* and inserted into the upper chamber 102*a*, and whose lower end is formed with a relatively larger outer diameter than the first inner diameter 102*c*-1 to close the first inner diameter 102*c*-1 while being press-fitted to the lower end of the first inner diameter 102*c*-1.

Furthermore, it is preferable that a plurality of inlet grooves 102*c*-3 are formed along a circumferential direction at an upper outer periphery of the inner diameter of the dip tube 102*c* where the dip tube 102*c* and the chamber 102*a* are connected.

As described above, the cosmetic container cap with a duo-mix function of the present disclosure has an effect that when mixing the second cosmetic content stored in the container and the first cosmetic content of the cap coupled to the container, the first cosmetic content and the second cosmetic content can be mixed without removing the cap from the container. In addition, the cosmetic container cap with a duo-mix function of the present disclosure has the effect of maintaining the aesthetics of the appearance since the sealing member that prevents the first cosmetic content of the body part and the pumping member from leaking is concealed without staying inside the container even when the first cosmetic content and the second cosmetic content are mixed.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

The configuration of a cosmetic container cap with a duo-mix function according to the present disclosure will be described with reference to the accompanying FIGS. 2 and 3 as follows.

Figure 1A:
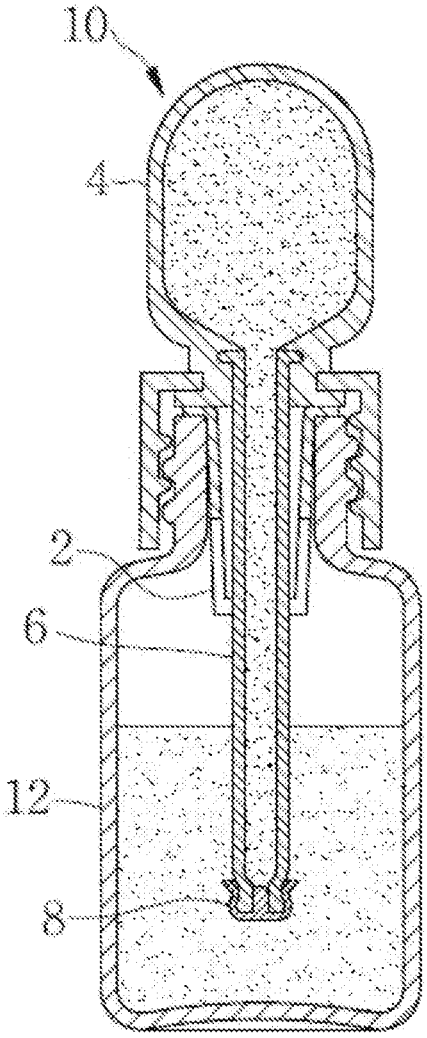
FIG. 1A PRIOR ART
FIGS. 1A-1C are views showing a conventional cosmetic container for mixing different types of cosmetic contents.
Figure 1B:
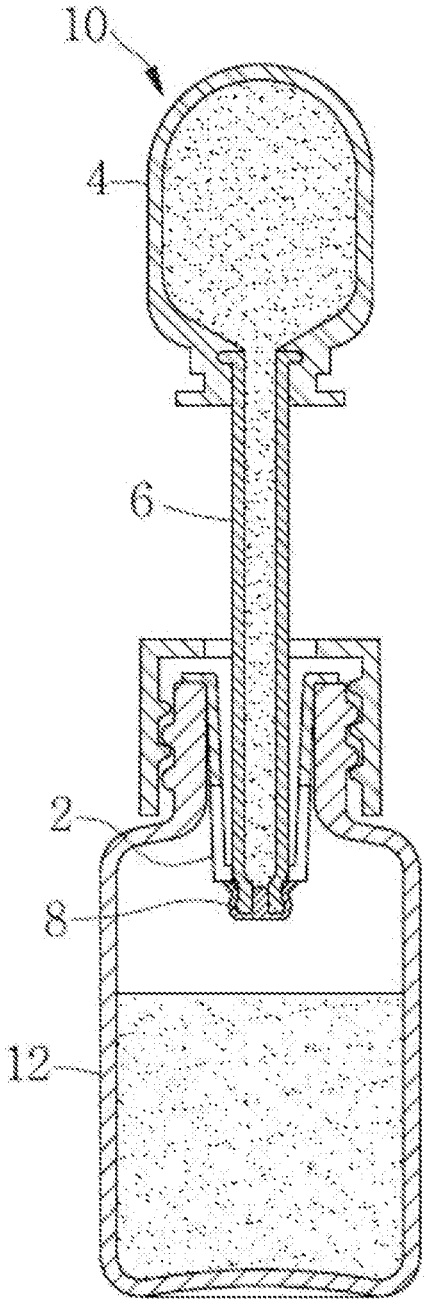
FIG. 1B PRIOR ART
Figure 1C:
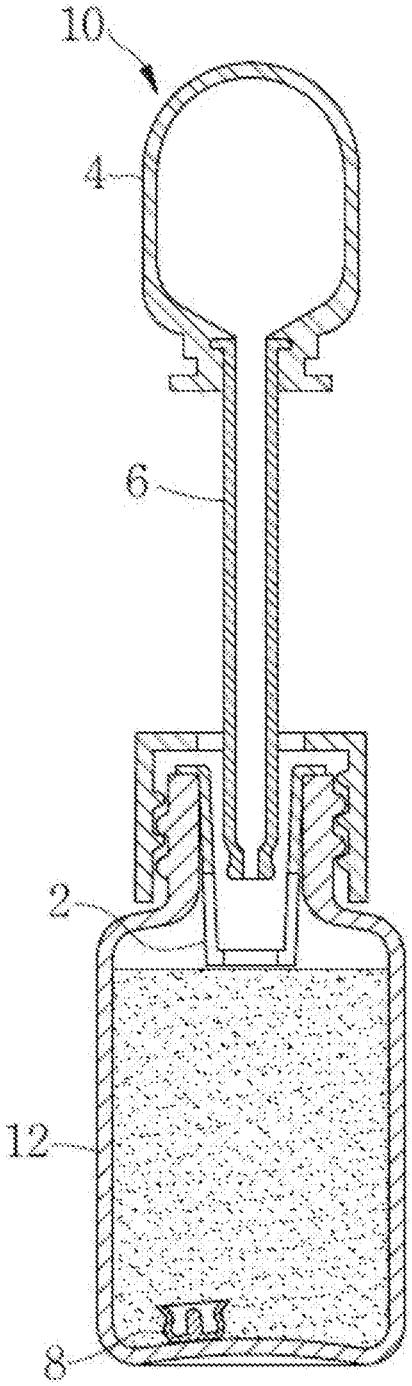
FIG. 1C PRIOR ART
Figure 2:
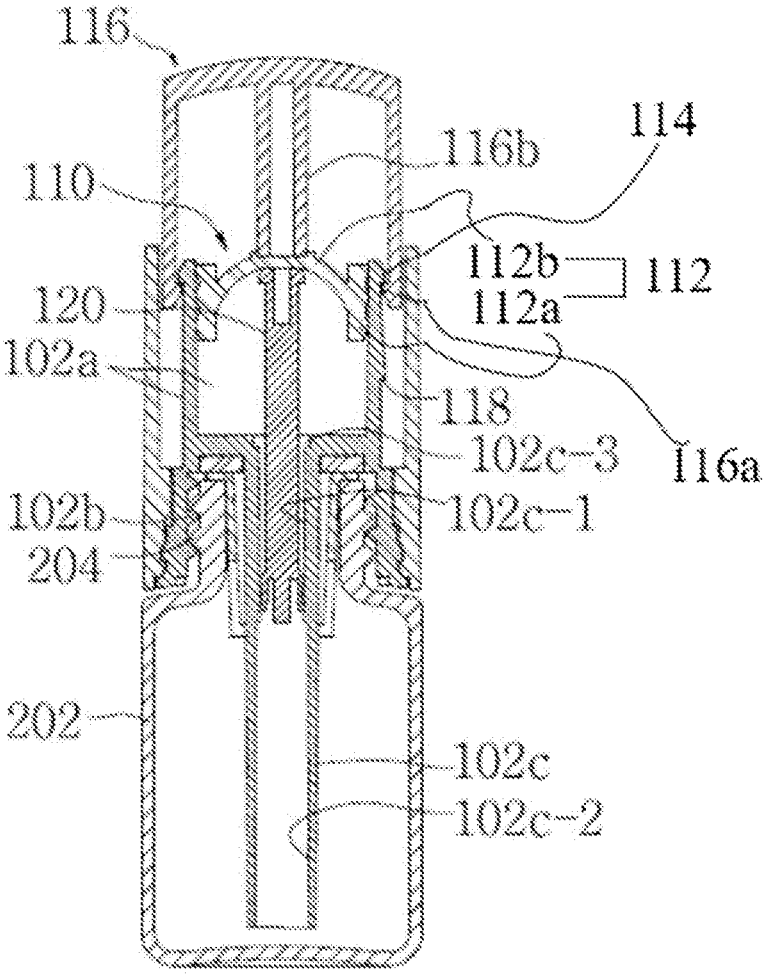
FIG. 2 is a cross-sectional view showing the overall structure of a cosmetic container cap with a duo-mix function according to the present disclosure coupled to a container.

As shown in FIG. 2, the cosmetic container cap with a duo-mix function of the present disclosure includes: a body part 102 fastened to an opening of a container 202 so as to be coupled and detached; a pumping member 110 coupled to the body part 102; and a dip tube sealing means for sealing a dip tube 102*c* of the body part 102.

Figure 3:
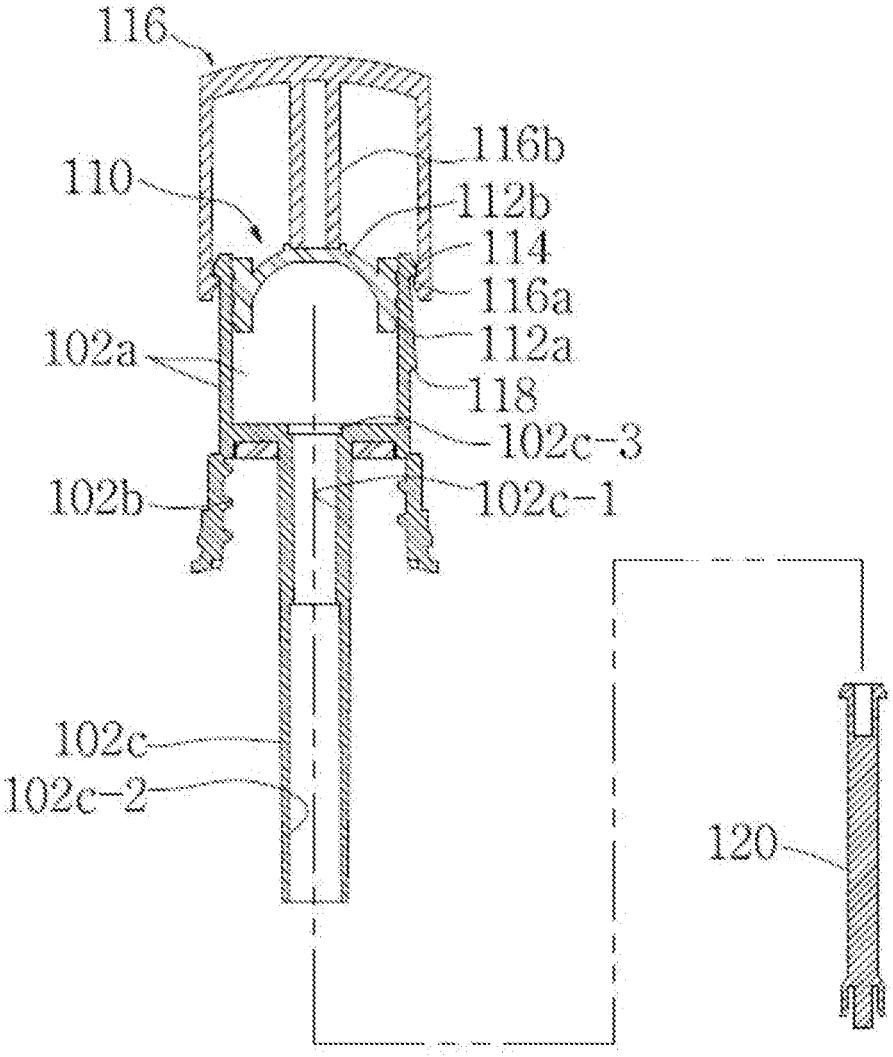
FIG. 3 is a view showing the structure of the cosmetic container cap with a duo-mix function according to the present disclosure.

As shown in FIG. 3, the body part 102 is provided with an upper open-type chamber 102*a* having an accommodation space to accommodate the first cosmetic content A formed at the upper portion thereof, and a female fastening portion 102*b* formed at the lower portion thereof to be fastened to a male fastening portion 204 formed to be exposed in the opening of the container 202.

In addition, a hollow dip tube 102*c* is formed with a predetermined length downward from the lower portion of the chamber 102*a* of the body part 102, so that the chamber 102*a* and the dip tube 102*c* communicate with each other.

Meanwhile, the pumping member 110 is coupled to the body part 102 to discharge the first cosmetic content A accommodated in the chamber 102*a* downward into the container 202, and to cause the cosmetic mixture C formed by mixing the first cosmetic content A with the second cosmetic content B inside the container 202 to be discharged (pumped) after being sucked into the chamber 102*a* or into the dip tube 102*c*.

That is, in the case of the pumping member 110, a close-contact portion 112*a* is inserted downwardly from the upper portion of the accommodation space of the chamber 102*a* to the lower portion of the accommodation space of the chamber 102*a* so as to be in close contact with the upper periphery of the inner diameter surface of the chamber 102*a* in order to descend by the downward pressing force acting from the outside, and an elastic portion 112*b* is formed in a convex shape in the close-contact portion 112*a* to constitute a pumping material 112.

The elastic portion 112*b* is formed to extend convexly upward from the close-contact portion 112*a*, and by allowing the elastic portion 112*b* to be elastically restored upward when the downward pressure is applied, the air inside the chamber 102*a* is exhausted to the dip tube 102*c* and then external air is sucked in by the elastic restoring force.

Meanwhile, in order to directly lower or pump the pumping material 112, a button part 116 is coupled to the chamber 102*a*, and at least one first hook 114 is protruded outwardly as shown in FIG. 3 on the outer diameter of the chamber 102*a*, and the button part 116 is inserted downward into the outer diameter of the chamber 102*a*.

On the inner diameter of the lower end of the button part 116, a second hook 116*a* is formed to protrude inward as shown, so that the button part 116 is interfered upward after being forced through the first hook 114 when the button part 116 is inserted downward into the outer diameter of the chamber 102*a*.

At this time, a pressing portion 116*b* is formed extending downwardly on the bottom surface of the button part 116 so as to be in close contact with the upper portion of the elastic portion 112*b* of the pumping material 112 to press the elastic portion 112*b* when the button part 116 is inserted downward into the outer diameter of the chamber 102*a*.

In addition, a third hook 118 is formed at a predetermined height of the outer diameter of the chamber 102*a*, so that after the button part 116 is lowered by a predetermined distance from the outer diameter of the chamber 102*a*, the first hook 114 of the button part 116 is forced through the third hook 118 and then is interfered in order to prevent the button part 116 from being elevated above a predetermined height after descending to lower the close-contact portion 112*a* and the elastic portion 112*b*.

Accordingly, the button part 116 is not elevated further above the position of the third hook 118 by the first hook 114 interfered by the third hook 118.

Meanwhile, in the present disclosure, the dip tube sealing means is provided for keeping the dip tube 102*c* closed and then opening the dip tube 102*c* according to a user's intention so that the first cosmetic content A and the second cosmetic content B are mixed. This is to prevent the first cosmetic content A from leaking through the dip tube 102*c* and then mixing with the second cosmetic content B filled in the container 202 when there is no user's intention after filling the chamber 102*a* of the body part 102 with the first cosmetic content A.

In the dip tube sealing means, a first inner diameter 102*c*-1 of a predetermined length formed on the upper portion of the dip tube 102*c* is formed narrower than a second inner diameter 102*c*-2 of a predetermined length formed on the lower portion of the dip tube 102*c*. In addition, the dip tube sealing means is provided with a sealing part 120 loosely inserted upward from the lower end of the dip tube 102*c* and inserted into the upper chamber 102*a*, and whose lower end is formed with a relatively larger outer diameter than the first inner diameter 102*c*-1 to close the first inner diameter 102*c*-1 while being press-fitted to the lower end of the first inner diameter 102*c*-1.

It is preferable that a plurality of inlet grooves 102*c*-3 are formed along the circumferential direction at the upper outer periphery of the inner diameter of the dip tube 102*c* where the dip tube 102*c* and the chamber 102*a* are connected to facilitate the inflow and discharge of the first cosmetic content A or the cosmetic mixture C inside the chamber 102*a*.

At this time, the first cosmetic content A may be in the form of liquid or powder, and the second cosmetic content B may also be in the form of liquid or powder, and thus, in the present disclosure, the types of the first cosmetic content A and the second cosmetic content B are not limited and may be selected and changed in various ways.

The function of the cosmetic container cap with a duo-mix function according to the present disclosure configured as described above will be described with reference to the accompanying FIGS. 4A to 6F.

Figure 4A:
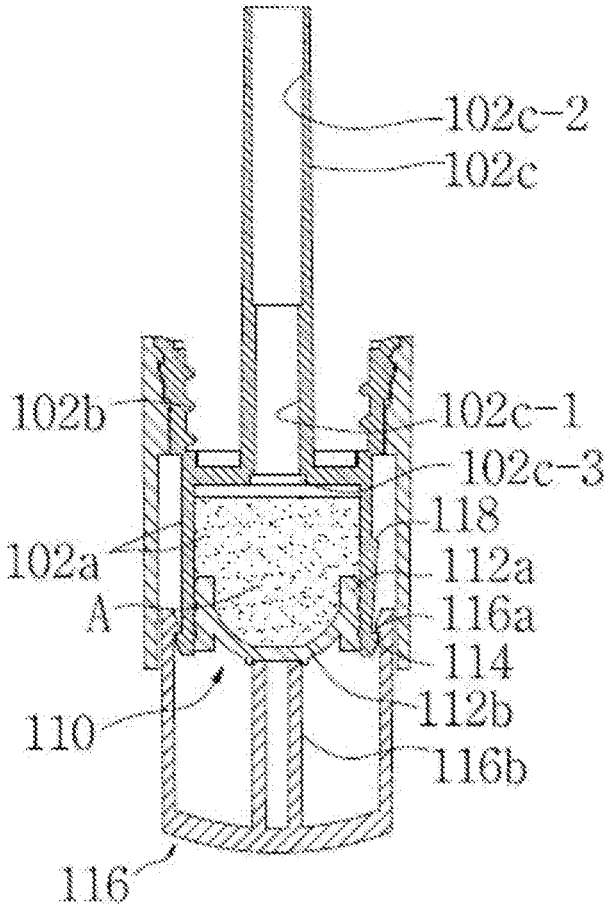
FIGS. 4A to 4C are views showing a process of filling the first cosmetic content in the cosmetic container cap with a duo-mix function according to the present disclosure.
Figure 4B:
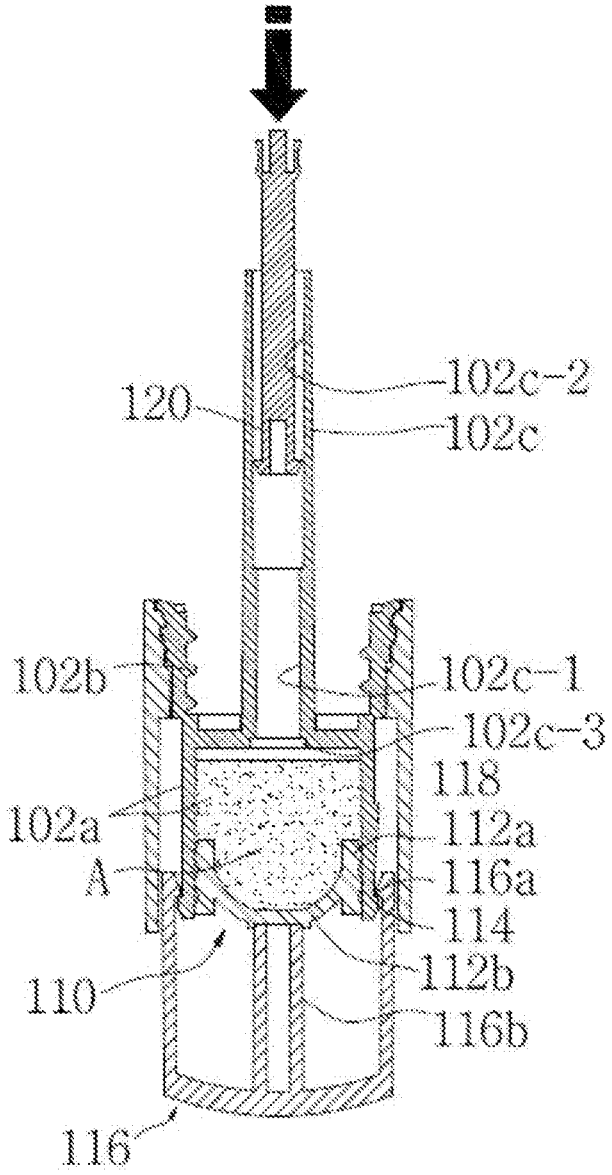
Figure 4C:
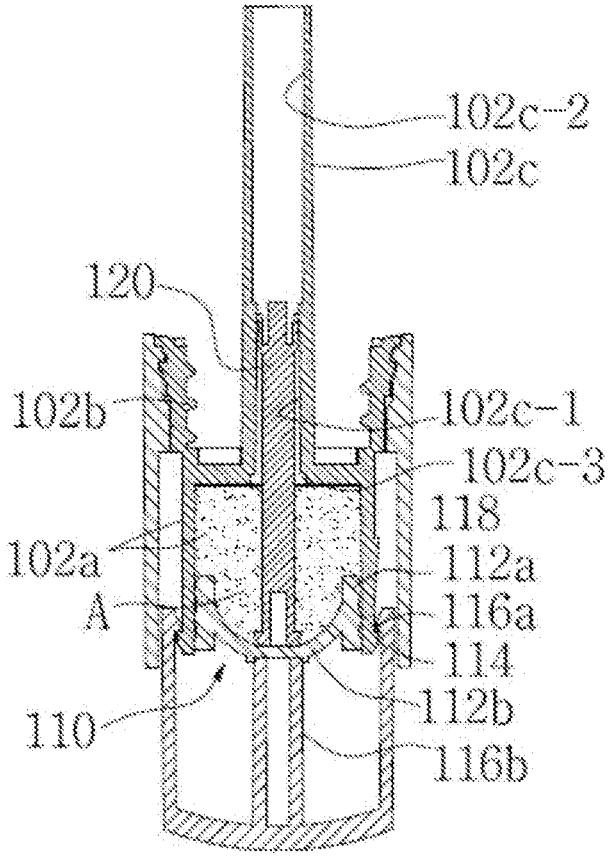

FIGS. 4A, 4B, and 4C are views showing a process of filling or accommodating the first cosmetic content A in the cosmetic container cap with a duo-mix function according to the present disclosure.

As shown in FIG. 4A, when filling the chamber 102*a* of the body part 102 with the first cosmetic content A, the button part 116 is directed downward, and the end of the dip tube 102*c* is directed upward, so that the first cosmetic content A is filled into the first inner diameter 102*c*-1 and the chamber 102*a* through the second inner diameter 102*c*-2.

At this time, the first cosmetic content A filled in the chamber 102*a* is prevented from leaking to the outside since the close-contact portion 112*a* of the pumping material 112 maintains a state in close contact with the inner diameter of the chamber 102*a*.

As described above, when the first cosmetic content A is filled in the chamber 102*a*, the sealing part 120 is inserted downwardly into the end of the dip tube 102*c* as shown. At this time, the sealing part 120 is loosely inserted because the outer diameter thereof is formed to be relatively smaller than the second inner diameter 102*c*-2 and the first inner diameter 102*c*-1, and one end of the sealing part 120 is close to or in close contact with the bottom surface of the elastic portion 112*b* of the pumping material 112 as shown in FIG. 4C, whereas the other end of the sealing part 120 has a smaller outer diameter than the second inner diameter 102*c*-2 as shown in FIG. 4B, but has a larger outer diameter than the first inner diameter 102*c*-1, and is elastically formed to reduce the diameter by external pressure. Thus, when the end of the sealing part 120 is inserted up to the first inner diameter 102*c*-1 as shown in FIG. 4C, the other end of the sealing part 120 is press-fitted to the first inner diameter 102*c*-1, and the first inner diameter 102*c*-1 of the dip tube 102*c* may be sealed.

Figure 5:
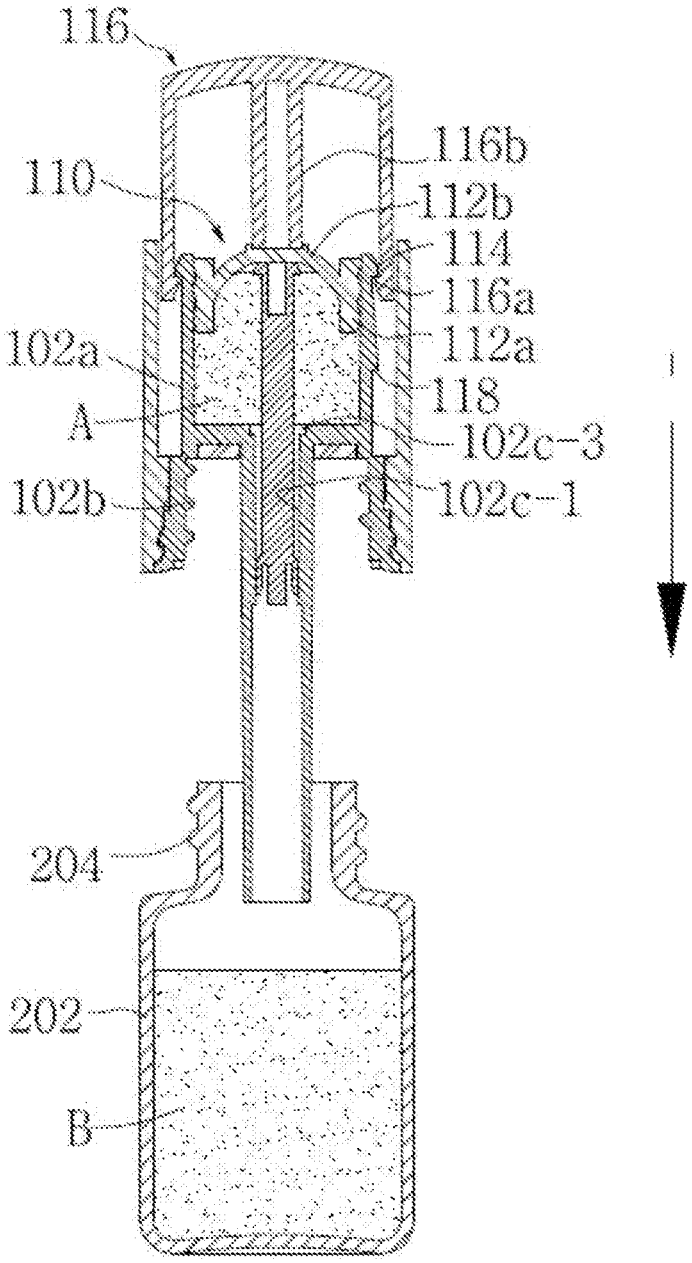
FIG. 5 is a view showing a state in which the cosmetic container cap with a duo-mix function filled with the first cosmetic content is coupled to the container.

As described above, after filling the chamber 102*a* with the first cosmetic content A and sealing the dip tube 102*c* using the sealing part 120, the female fastening portion 102*b* of the cosmetic container cap with a duo-mix function according to the present disclosure is fastened to the male fastening portion 204 of the opening of the container 202 filled with the second cosmetic content B as shown in FIG. 5, so that the second cosmetic content B of the container 202 and the first cosmetic content A of the cap do not mix with each other during storage and distribution by the sealing force of the sealing part 120.

Meanwhile, FIGS. 6A, 6B, 6C, 6D, 6E, and 6F show that the first cosmetic content A is discharged and mixed with the second cosmetic content B to be used in a state in which the first cosmetic content A and the second cosmetic content B are separately stored and distributed by using the cosmetic container cap with a duo-mix function according to the present disclosure.

Figure 6A:
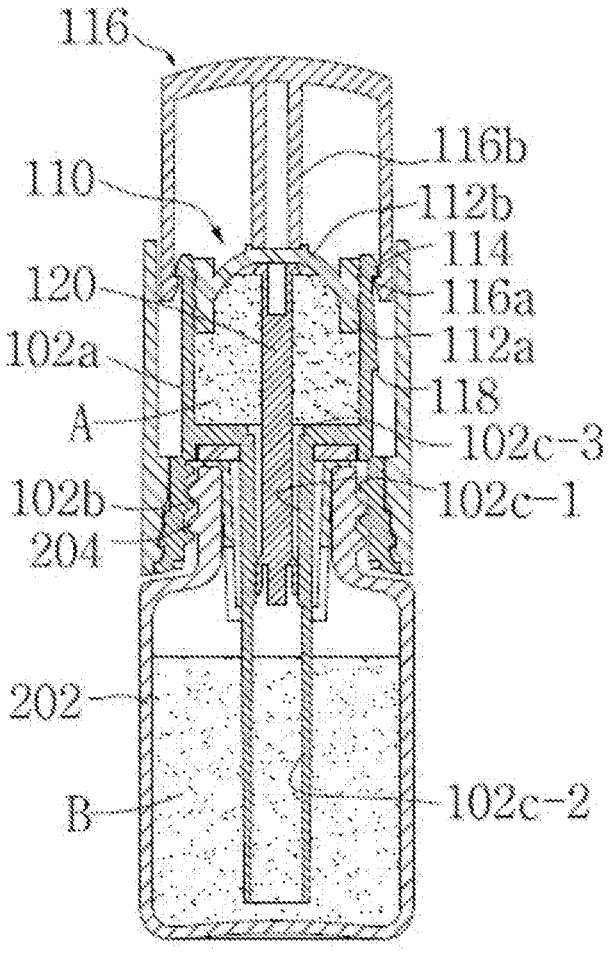
FIGS. 6A to 6F are views showing a process of using the cosmetic container cap with a duo-mix function according to the present disclosure.
Figure 6B:
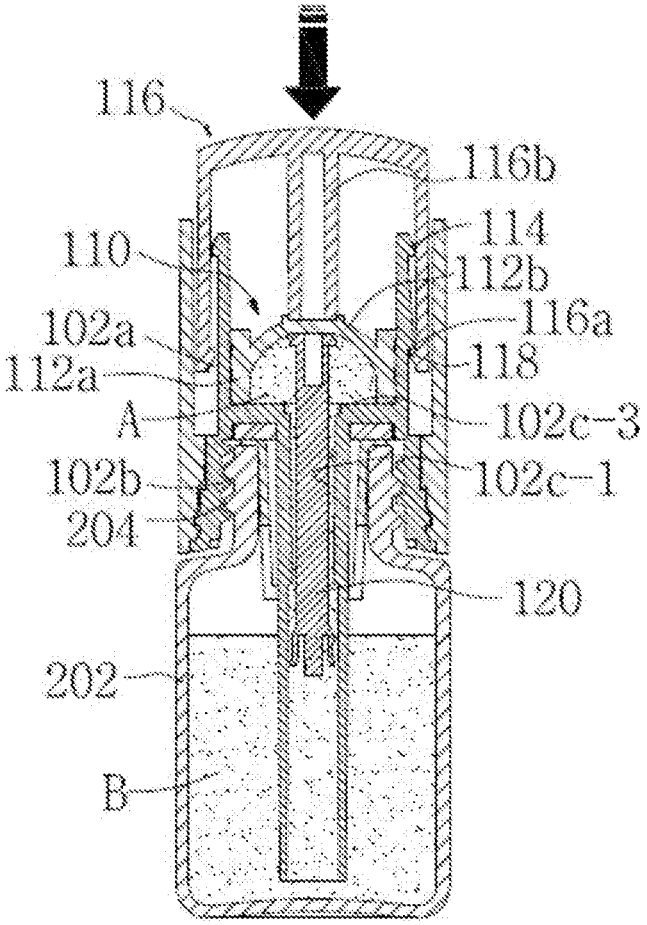

That is, FIG. 6A is a view showing a state in which the first cosmetic content A and the second cosmetic content B are separated during storage and distribution, and if the button part 116 is lowered when in use as shown in FIG. 6B, the pressing portion 116*b* of the button part 116 presses the elastic portion 112*b* of the pumping material 112 downward, and at this time, one end of the sealing part 120 that is close to or in close contact with the bottom surface of the elastic portion 112*b* is descended by the descending force of the button part 116.

Figure 6C:
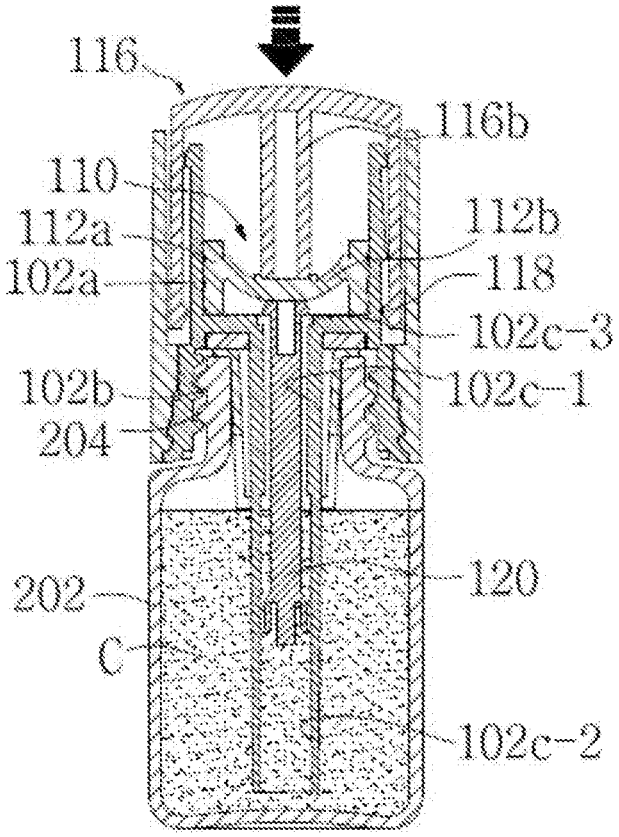

Accordingly, the other end of the sealing part 120 sealing the dip tube 102*c* is separated from the first inner diameter 102*c*-1 while descending, and when the button part 116 further descends along the outer diameter of the chamber 102*a*, the close-contact portion 112*a* is further lowered to descend to the bottom of the chamber 102*a* in a state in which the elastic portion 112*b* of the pumping material 112 is concave as shown in FIG. 6C.

As the button part 116 descends along the outer diameter of the chamber 102*a*, and the second hook 116*a* formed at the lower end of the button part 116 rides over the third hook 118 formed at the lower portion of the outer diameter of the chamber 102*a* as shown in FIG. 6C, the button part 116 is interfered by the third hook 118 and may not be lifted upwards above a predetermined height even if the elastic portion 112*b* is in a convexly elastically restored state.

Figure 6D:
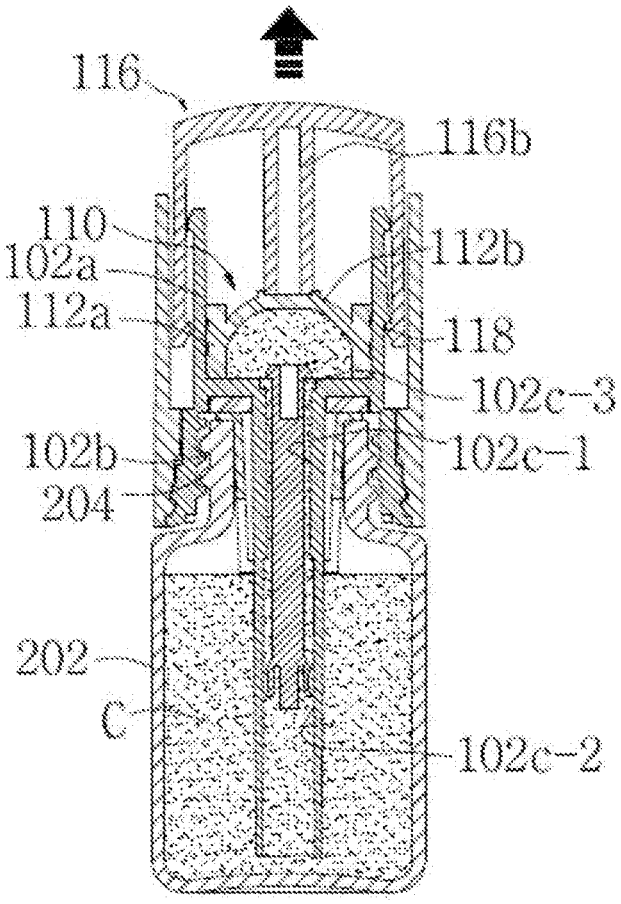

Meanwhile, as described above, as the sealing part 120 is separated from the first inner diameter 102*c*-1 by the pressing portion 116*b* of the button part 116 and descends, the first cosmetic content A and the second cosmetic content B are mixed and the resulting mixture is formed, and the button part 116 is lowered as shown in FIG. 6C so that the elastic portion 112*b* is lowered concavely to compress the chamber 102*a*, and then the elastic portion 112*b* of the chamber 102*a* is elastically restored and expanded so that the mixture is sucked into the dip tube 102*c* as shown in FIG. 6D.

Figure 6E:
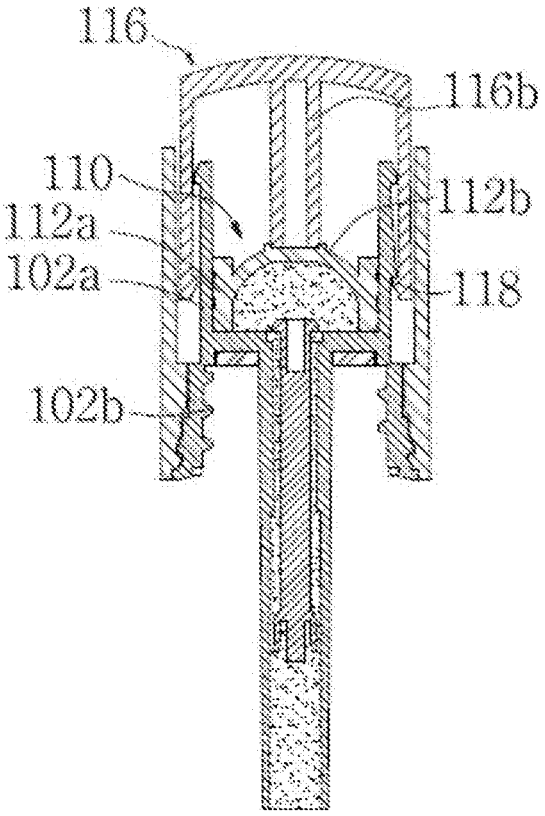
Figure 6F:
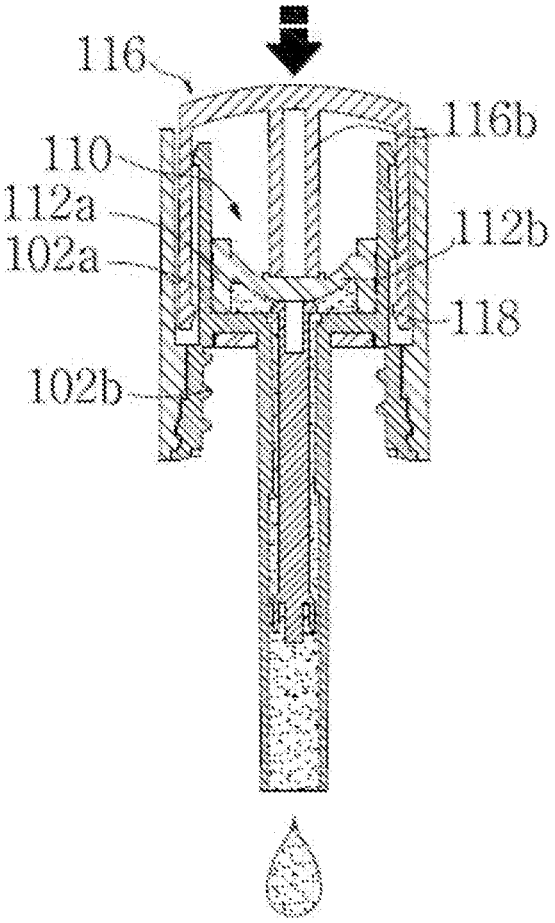

In addition, when the button part 116 is lowered again after the cap is separated from the container 202 as shown in FIG. 6E, the elastic portion 112*b* of the pumping material 112 is concavely deformed and the space inside the chamber 102*a* is compressed, so that the mixture sucked into the chamber 102*a* and the dip tube 102*c* is discharged to the end of the dip tube 102*c*, facilitating the use of the mixture.

What is claimed is:

1. A cosmetic container cap with a duo-mix function, comprising:

a body part (102) in which a female fastening portion (102*b*) is formed below an upper open-type chamber (102*a*) where an accommodation space is formed to accommodate a first cosmetic content (A) of liquid or powder so as to be fastened to a male fastening portion (204) formed to be exposed in a container (202), and having a hollow dip tube (102*c*) formed to extend a predetermined length downward from the chamber (102*a*);

a pumping member (110) coupled to the chamber (102*a*) of the body part (102) to press down the first cosmetic content (A) toward the container (202) to be mixed with a second cosmetic content (B) inside the container (202), and configured to pump a cosmetic mixture (C) in which the first cosmetic content (A) and the second cosmetic content (B) are mixed into the dip tube (102*c*) and the chamber (102*a*) to be discharged outside; and a dip tube sealing means for closing and opening the dip tube (102*c*) so that the first cosmetic content (A) and the second cosmetic content (B) are mixed.

2. The cosmetic container cap with a duo-mix function of claim 1, wherein the pumping member (110) comprises:

a pumping material (112) including a close-contact portion (112*a*) that is in close contact with an upper periphery of an inner diameter surface of the chamber (102*a*) and descends by a downward pressing force applied from the outside, and an elastic portion (112*b*) that is formed upwardly convex in the close-contact portion (112*a*) and is elastically restored upward when pressed downward;

at least one first hook (114) formed on an outer diameter of the chamber (102*a*);

a button part (116) inserted downward into an outer diameter of the chamber (102*a*), having a second hook (116*a*) formed on an inner diameter of a lower end thereof so that the button part (116) is interfered upward after being forced through the first hook (114) when inserted downward, and having a pressing portion (116*b*), which is in close contact with an upper portion of an elastic portion (112*b*) when the button part (116) is inserted downward into the outer diameter of the chamber (102*a*), formed to extend downward from a bottom thereof; and a third hook (118) formed at a predetermined height of the outer diameter of the chamber (102*a*) so that the first hook (114) of the button part (116) is interfered upward after being forced through when the button part (116) is lowered.

3. The cosmetic container cap with a duo-mix function of claim 2, wherein in the dip tube sealing means, a first inner diameter (102*c*-1) of a predetermined length formed on the upper portion of the dip tube (102*c*) is formed narrower than a second inner diameter (102*c*-2) of a predetermined length formed on a lower portion of the dip tube 102*c*, and the dip tube sealing means includes a sealing part (120) loosely inserted upward from the lower end of the dip tube (102*c*) and inserted into the upper chamber (102*a*), and whose lower end is formed with a relatively larger outer diameter than the first inner diameter (102*c*-1) to close the first inner diameter (102*c*-1) while being press-fitted to the lower end of the first inner diameter (102*c*-1).

4. The cosmetic container cap with a duo-mix function of claim 1, wherein a plurality of inlet grooves (102*c*-3) are formed along a circumferential direction at an upper outer periphery of the inner diameter of the dip tube (102*c*) where the dip tube (102*c*) and the chamber (102*a*) are connected.

* * * * *